US009869525B1

(12) United States Patent
Howe et al.

(10) Patent No.: US 9,869,525 B1
(45) Date of Patent: Jan. 16, 2018

(54) WEAPON SIGHT LIGHT EMISSION SYSTEM

(71) Applicant: North Pass, Ltd., Laramie, WY (US)

(72) Inventors: Phillip D. Howe, Laramie, WY (US); Bradley R. Smith, Timnath, CO (US); Richard A. Moore, Fort Collins, CO (US)

(73) Assignee: North Pass, Ltd., Laramie, WY (US)

( * ) Notice: Subject to any disclaimer, the term of this patent is extended or adjusted under 35 U.S.C. 154(b) by 0 days.

(21) Appl. No.: 15/268,468

(22) Filed: Sep. 16, 2016

(51) Int. Cl.
*F41G 1/00* (2006.01)
*F41G 1/32* (2006.01)
*F41G 1/02* (2006.01)

(52) U.S. Cl.
CPC *F41G 1/32* (2013.01); *F41G 1/02* (2013.01)

(58) Field of Classification Search
CPC ... F41G 1/32; F41G 1/345; F41G 1/02; F41G 1/033; C09K 11/02
See application file for complete search history.

(56) References Cited

U.S. PATENT DOCUMENTS

| | | | | |
|---|---|---|---|---|
| 815,090 | A | 3/1906 | Hukill | |
| 1,363,553 | A | 12/1920 | Barringer | |
| 1,818,381 | A | 8/1931 | Caruth | |
| 3,192,632 | A | 7/1965 | Von Stavenhagen | |
| 3,641,676 | A | 2/1972 | Knutsen et al. | |
| 4,495,705 | A | 1/1985 | Kowalski et al. | |
| 4,574,335 | A | 3/1986 | Frimer | |
| 5,065,519 | A | 11/1991 | Bindon | |
| 5,440,458 | A * | 8/1995 | Volk | F21V 33/0068 206/5.1 |
| 5,548,493 | A * | 8/1996 | Young | F21K 2/00 250/462.1 |
| 5,638,604 | A | 6/1997 | Lorocco | |
| 5,752,761 | A * | 5/1998 | Pietruczynik | B44F 1/02 250/462.1 |
| 6,005,024 | A | 12/1999 | Anders et al. | |
| 6,058,616 | A | 5/2000 | Bubits | |
| 6,360,472 | B1 | 3/2002 | Lorocco | |
| 6,375,864 | B1 | 4/2002 | Phillips et al. | |
| 6,385,855 | B1 | 5/2002 | Tymianski | |
| 6,571,482 | B1 | 6/2003 | Tymianski | |
| 6,596,074 | B2 | 7/2003 | Pomeroy | |
| 7,238,301 | B2 | 7/2007 | Huang et al. | |
| 7,338,877 | B1 * | 3/2008 | Meyer | D01D 5/34 428/373 |
| 7,451,566 | B1 | 11/2008 | Price | |
| D679,359 | S | 4/2013 | Adock, Jr. | |
| 8,425,063 | B2 | 4/2013 | Buckingham et al. | |
| 8,635,800 | B2 | 1/2014 | Glimpse et al. | |
| 8,635,801 | B2 | 1/2014 | Glimpse et al. | |
| D700,268 | S | 2/2014 | Hormberg | |

(Continued)

*Primary Examiner* — Michael David
(74) *Attorney, Agent, or Firm* — Craig R. Miles; CR Miles P.C.

(57) ABSTRACT

Disclosed herein are embodiments of a sighting device, and methods of making and using such a sighting device, whereby the sighting device comprises a chamber coupled to the sighting device; and a light-emitting element contained within the chamber; wherein the chamber contains only non-radioactive material; and wherein the light-emitting element emits a first amount of visible light to provide a viewable aiming indicium in low light conditions.

15 Claims, 9 Drawing Sheets

(56) References Cited

U.S. PATENT DOCUMENTS

| | | | |
|---|---|---|---|
| 8,925,237 | B2 | 1/2015 | Howe et al. |
| 2011/0107650 | A1 | 5/2011 | Howe et al. |
| 2011/0314721 | A1 | 12/2011 | Lamb |
| 2012/0198750 | A1 | 8/2012 | Mansfield |
| 2013/0255129 | A1 | 10/2013 | Curry |
| 2014/0096430 | A1 | 4/2014 | Kruse |

* cited by examiner

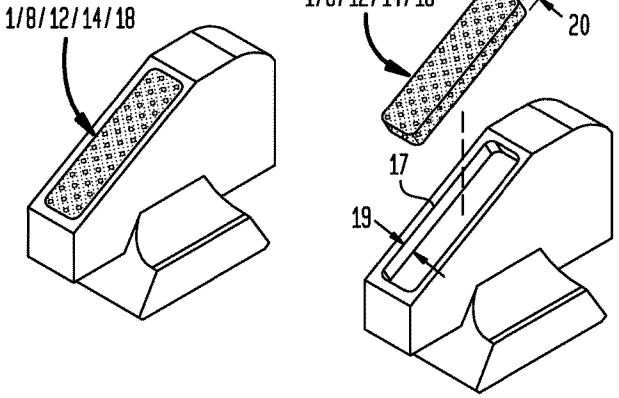
FIG. 4A
FIG. 4B
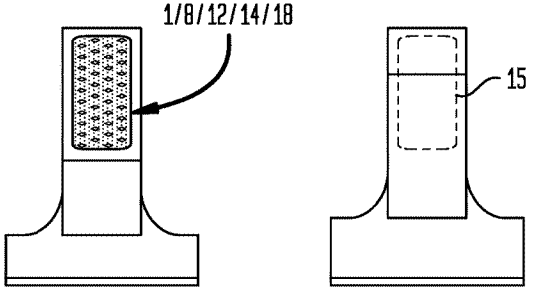
FIG. 4C
FIG. 4D
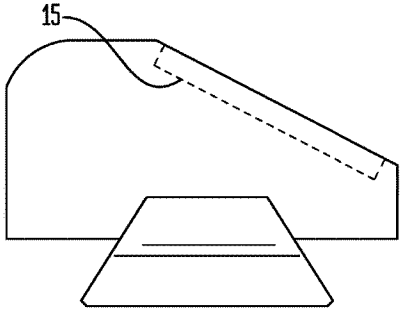
FIG. 4E
FIG. 4F
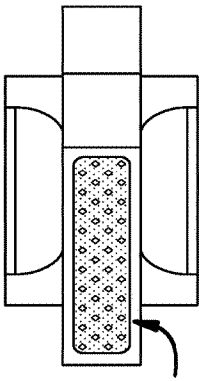
FIG. 4G
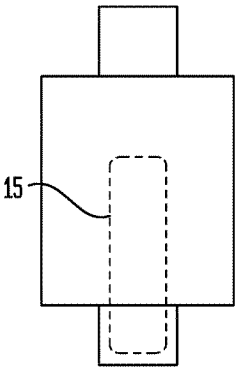
FIG. 4H

WEAPON SIGHT LIGHT EMISSION SYSTEM

I. SUMMARY OF THE INVENTION

A broad object of a particular embodiment of the invention can be to provide a sighting device, and methods of making and using such a sighting device, whereby the sighting device comprises a chamber coupled to the sighting device; and a light-emitting element contained within the chamber; wherein the chamber contains only non-radioactive material; and wherein the light-emitting element emits a first amount of visible light to provide a viewable aiming indicium in low light conditions.

Another broad object of a particular embodiment of the invention can be to provide the above-described sighting device whereby the chamber is disposed inside of a light conductive member.

II. A BRIEF DESCRIPTION OF THE DRAWINGS

FIG. 4A is a perspective view of a particular embodiment of the inventive sighting device.

FIG. 4B is an exploded view of the particular embodiment of the inventive sighting device shown in FIG. 4A.

FIG. 4C is a front view of the particular embodiment of the inventive sighting device shown in FIG. 4A.

FIG. 4D is a rear view of the particular embodiment of the inventive sighting device shown in FIG. 4A.

FIG. 4E is a first side view of the particular embodiment of the inventive sighting device shown in FIG. 4A.

FIG. 4F is a second side view of the particular embodiment of the inventive sighting device shown in FIG. 4A.

FIG. 4G is a top view of the particular embodiment of the inventive sighting device shown in FIG. 4A.

FIG. 4H is a bottom view of the particular embodiment of the inventive sighting device shown in FIG. 4A.

III. DETAILED DESCRIPTION OF THE PREFERRED EMBODIMENTS

Figure 1:
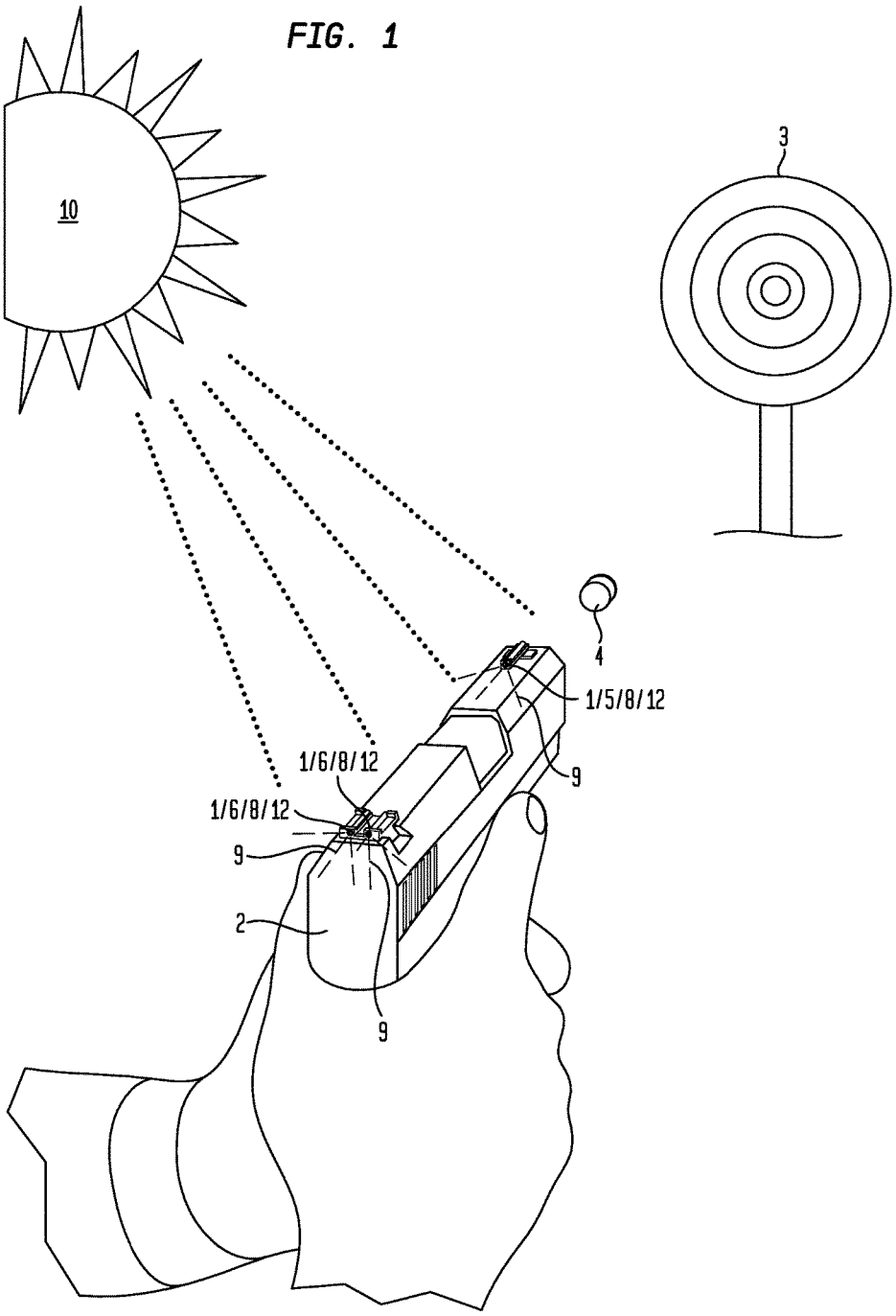
FIG. 1 is an illustration of a method of using a particular embodiment of the inventive sighting device in combination with a weapon to assist with or facilitate aiming the weapon at a target to direct a projectile toward the target.

Now referring primarily to FIG. 1, which illustrates a method of using a particular embodiment of the inventive sighting device (1) in combination with a weapon (2) to assist with or facilitate aiming the weapon (2) at a target (3) to direct a projectile (4) toward the target (3).

Of note, the term "weapon" is not intended to be limiting, but rather broadly encompasses apparatuses which can be aimed at a target (3) and can launch a projectile(s) (4) or other material toward the target (3), such as for military, sport, hobby, or other applications. As but a few examples, weapons can include firearms, guns, hand guns, rifles, shot guns, machine guns, pellet guns, BB guns, laser guns or weapons, directed-energy weapons, bows, or the like.

Further of note, a target (3) comprises any object toward which the weapon (2) can be aimed and following launch, can receive the projectiles(s) (4), including inanimate and animate objects.

Figure 2A:
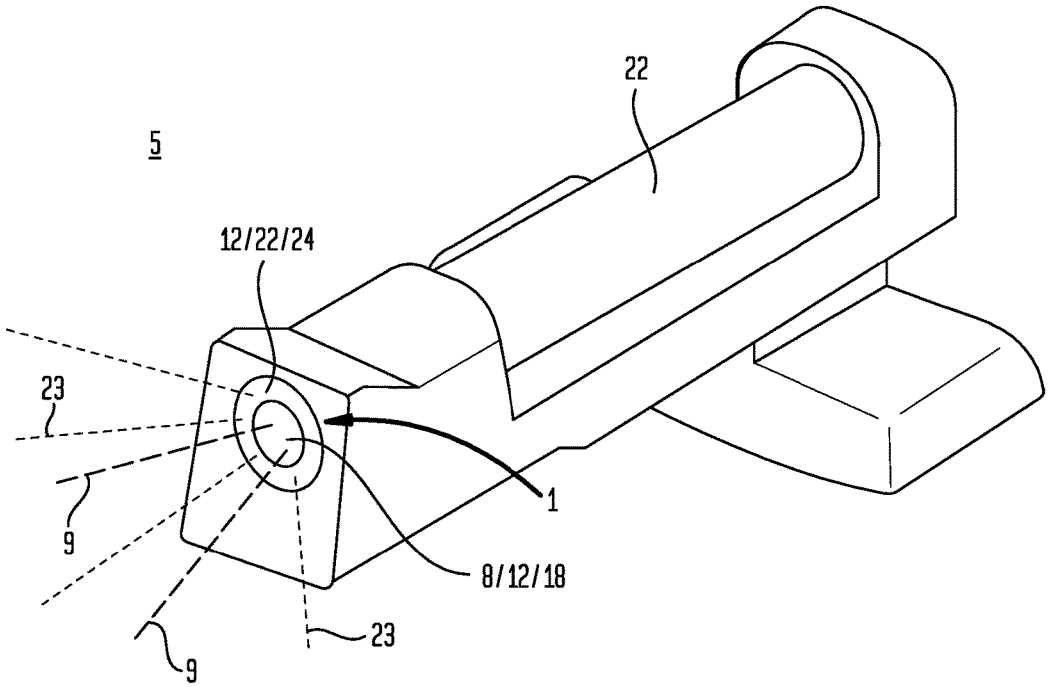
FIG. 2A is a perspective view of a particular embodiment of the inventive sighting device incorporated into a front sight.
Figure 2B:
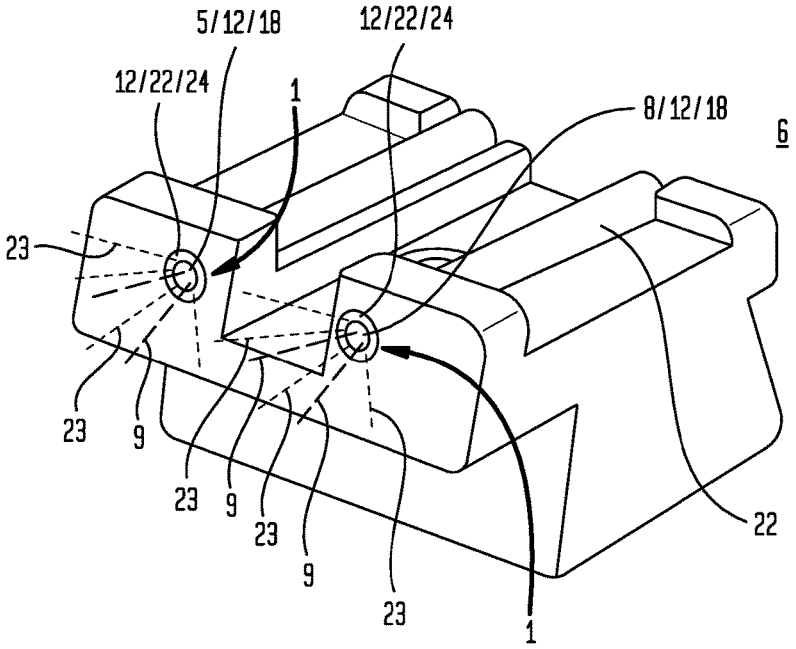
FIG. 2B is a perspective view of a particular embodiment of the inventive sighting device incorporated into a rear sight.

Now referring primarily to FIG. 1 and FIG. 2, as to particular embodiments, the sighting device (1) can be incorporated into a front sight (5) and a rear sight (6), whereby one or both of the front and rear sights (5)(6) can be coupled to the weapon (2) in fixed (or immovable) or adjustable relation to allow positional alignment of the front and rear sights (5)(6) to assist with or facilitate aiming the weapon (2) at a target (3) to direct a projectile (4) toward the target (3).

Now referring primarily to FIG. 3A through FIG. 4I, the sighting device (1) includes a chamber (7) and a light-emitting element (8) contained within the chamber (7), whereby the light-emitting element (8) emits a first amount of visible light (9) following exposure to a light source (10), whether natural or artificial. The light source (10), which can provide visible light, invisible light (such as ultraviolet light or infrared light), or combinations thereof, functions as an excitation source. Upon absorption of radiation from the light source (10), electrons of the light-emitting element (8) are excited, thereby effectively activating or charging the light-emitting element (8).

Particularly, the light-emitting element (8) can be a phosphorescent material (11) which, in contrast to fluorescent material, does not immediately re-emit the absorbed radiation following exposure to a light source (10). Accordingly, even after discontinuation of exposure to the light source (10), the phosphorescent material (11) continues to emit a first amount of visible light (9), thereby providing prolonged luminescence, which may be perceived as an afterglow.

The term "prolong" for the purposes of the present invention means to continue to exist over time.

The term "luminescence" for the purposes of the present invention means light emission.

Thus, phosphorescent material (11) shows a relatively slow decay in luminescence relative to fluorescent material. Regarding the instant sighting device (1), the prolonged luminescence generated by the phosphorescent material (11) may be useful in combination with a weapon (2) to assist with or facilitate aiming the weapon (2) at a target (3) in low light conditions by providing a viewable aiming indicium (12).

Figure 5:
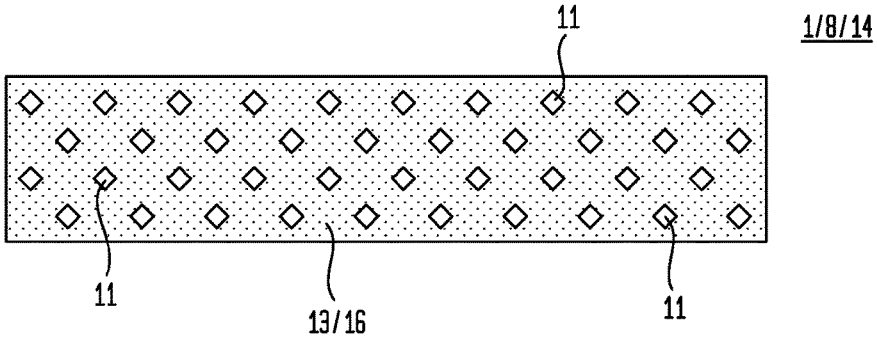
FIG. 5 is a side view of a particular light-emitting element of the inventive sighting device, whereby the light-emitting element comprises a phosphorescent material loaded within a curable resin.

Now referring primarily to FIG. 5, the phosphorescent material (11) can be loaded within a curable resin (13) to provide a phosphor-loaded resin (14) which can be contained within the chamber (7).

As to particular embodiments, the resin (13) can be formulated such that following disposition within the chamber (7), the resin (13) adheres to one or more chamber walls (15) which define the chamber (7) to fixedly (or immovably) secure the phosphor-loaded resin (14) within the chamber (7).

For example, the chamber walls (15) can be coated with a layer of protective coating, such as a layer of protective coating conventionally used to coat gun components (e.g. black nitride), whereby the resin (13) adheres to the layer of protective coating to fixedly secure the phosphor-loaded resin (14) within the chamber (7).

As to particular embodiments, the resin (13) can comprise an epoxy resin (16), which typically includes polymers containing epoxide groups. The polymers can react or cross-link either with themselves or with a wide variety of co-reactants, often referred to as hardeners, whereby the cross-linking reaction may be referred to as curing.

As to particular embodiments, the epoxy resin (16) can be provided as a two-part epoxy resin.

As to other particular embodiments, the epoxy resin (16) can be provided as a one-part epoxy resin, which may be considered advantageous over a two-part epoxy resin.

Now regarding the phosphor-loaded resin (14), combinations of a particular phosphorescent material (11) and epoxy resin (16) may be especially useful with the instant sighting device (1).

For example, the phosphorescent material (11) loaded within the resin (13) can be a persistent phosphor (or long persistent phosphor) which provides persistent luminescence (or long persistent luminescence), i.e., light emission persisting for a long time after excitation has ended.

As to particular embodiments, the phosphorescent material (11) can comprise strontium aluminate doped with europium and dysprosium ($SrAl_2O_4$:Eu,Dy; CAS Number: 282118-14-3), which emits green light and has a persistent time of about 9500 minutes. Relative to other persistent phosphors, $SrAl_2O_4$:Eu,Dy may be advantageous because of this crystal's high luminescent intensity, high quantum efficiency, long-lasting phosphorescence, and high chemical stability.

Of note, the phosphorescent material (11) of the instant sighting device (1) need not be limited to $SrAl_2O_4$:Eu,Dy and can include any of a numerous and wide variety of persistent phosphors which function similar to $SrAl_2O_4$:Eu,Dy. Additionally, the phosphorescent material (11) of the instant sighting device (1) need not be limited to emission of green light and can emit any of a numerous and wide variety of light colors, depending upon the application.

Now regarding the epoxy resin (16), as to particular embodiments, $SrAl_2O_4$:Eu,Dy can be loaded within an epoxy resin (16) comprising bisphenol A and epichlorohydrin (poly(bisphenolA-co-epichlorohydrin); CAS Number: 25068-38-6), whereby for curing, bisphenol A and epichlorohydrin combine to provide bisphenol A diglycidyl ethers.

Again regarding the phosphor-loaded resin (14), combinations of particular amounts of phosphorescent material (11) and epoxy resin (16) may be especially useful with the instant sighting device (1).

For example, the amount of phosphorescent material (11) or $SrAl_2O_4$:Eu,Dy can be in a range of between about 50% to about 80% by weight of the phosphor-loaded resin (14), although lesser or greater amounts may also be used. As to particular embodiments, the amount of phosphorescent material (11) or $SrAl_2O_4$:Eu,Dy can be selected from the group including or consisting of: between about 50% and about 60% by weight of the phosphor-loaded resin (14); between about 55% and about 65% by weight of the phosphor-loaded resin (14); between about 60% and about 70% by weight of the phosphor-loaded resin (14); between about 65% and about 75% by weight of the phosphor-loaded resin (14); and between about 70% and about 80% by weight of the phosphor-loaded resin (14). Generally, increasing the amount of phosphorescent material (11) or $SrAl_2O_4$:Eu,Dy within the phosphor-loaded resin (14) results in an increase in persistent luminescence. However, increasing the amount of phosphorescent material (11) or $SrAl_2O_4$:Eu,Dy within the phosphor-loaded resin (14) may also increase cost and can affect the non-luminance properties of the phosphor-loaded resin (14).

Regarding the epoxy resin (16), the amount of poly (bisphenolA-co-epichlorohydrin) can be not greater than about 35% by weight of the phosphor-loaded resin (14), although lesser or greater amounts may also be used. As to particular embodiments, the amount of poly(bisphenolA-co-epichlorohydrin) can be selected from the group including or consisting of: not greater than about 35% by weight of the phosphor-loaded resin (14); not greater than about 30% by weight of the phosphor-loaded resin (14); not greater than about 25% by weight of the phosphor-loaded resin (14); not greater than about 20% by weight of the phosphor-loaded resin (14); not greater than about 15% by weight of the phosphor-loaded resin (14); and not greater than about 10% by weight of the phosphor-loaded resin (14).

In addition to phosphorescent material (11) or $SrAl_2O_4$:Eu,Dy and the epoxy resin (16), various additives may be added to the phosphor-loaded resin (14) to achieve different results, such as to accelerate cure time, enhance durability, maximize clarity, improve pigment suspension, increase solvent resistance, or modify the flexibility of the cured phosphor-loaded resin (14).

As but one non-limiting example, the phosphor-loaded resin (14) can comprise $SrAl_2O_4$:Eu,Dy in an amount of about 60% to about 70% by weight of the phosphor-loaded resin (14), poly(bisphenolA-co-epichlorohydrin) in an amount of about 20% to about 25% by weight of the phosphor-loaded resin (14), poly(oxypropylene) diamine (CAS Number: 9046-10-0) in an amount of about 5% to about 10% by weight of the phosphor-loaded resin (14), buytlglycidylether (CAS Number: 2426-08-6) in an amount of about 1% to about 2.5% by weight of the phosphor-loaded resin (14), triethanolamine (CAS Number: 102-71-6) in an amount of about 1% to about 2.5% by weight of the phosphor-loaded resin (14), piperazine (CAS Number: 67762-90-7) in an amount of about 0.1% to about 1% by weight of the phosphor-loaded resin (14), and N-(2-aminoethyl)piperazine (CAS Number: 140-31-8) in an amount of about 0.1% to about 1% by weight of the phosphor-loaded resin (14).

Now regarding the chamber (7) which contains the phosphor-loaded resin (14), the chamber (7) can be coupled to or disposed within the sighting device (1), whereby the chamber (7) can have a chamber open end (17) through which the phosphor-loaded resin (14) can be passed for containment within the chamber (7).

As to particular embodiments, the exposed surface area (18) of the phosphor-loaded resin (14) which provides the first amount of visible light (9) and the viewable aiming indicium (12) can be defined by the bounds of the chamber open end (17), whether the phosphor-loaded resin (14) contained within the chamber (7) disposes flush with the chamber open end (17) or beneath the chamber open end (17).

Now referring primarily to FIG. 3A through FIG. 3I, as but one illustrative example, the chamber (7) can have a generally cylindrical shape (although the chamber (7) need not be limited to this shape) with a diameter of about 3/32 inch; following, the exposed surface area (18) of the phosphor-loaded resin (14) contained within the chamber (7) which provides the first amount of visible light (9) and the viewable aiming indicium (12) can be about 0.007 square inches.

Now referring primarily to FIG. 4A through FIG. 4I, as but another illustrative example, the chamber (7) can have a generally cube-like or cuboid-like shape (although the chamber (7) need not be limited to this shape) with a length of about 3/8 inch and a width of about 3/32 inch; following, the exposed surface area (18) of the phosphor-loaded resin (14) contained within the chamber (7) which provides the first amount of visible light (9) and the viewable aiming indicium (12) can be about 0.035 square inches.

Of course, in addition to the above-described illustrative examples, lesser and greater dimensions of the chamber open end (17) and correspondingly, the exposed surface area (18) of the phosphor-loaded resin (14) which provides the first amount of visible light (9) and the viewable aiming indicium (12), are contemplated herein, depending upon the application.

Figure 3A:
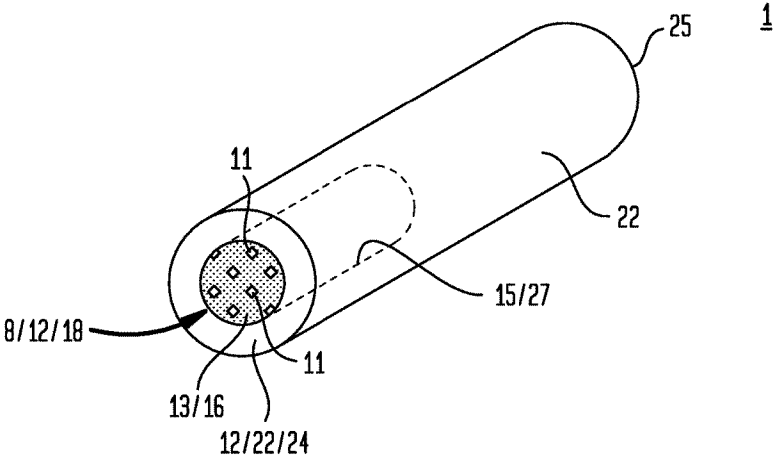
FIG. 3A is a perspective view of a particular embodiment of the inventive sighting device whereby a chamber containing a light-emitting element is disposed inside of a light conductive member.
Figure 3B:
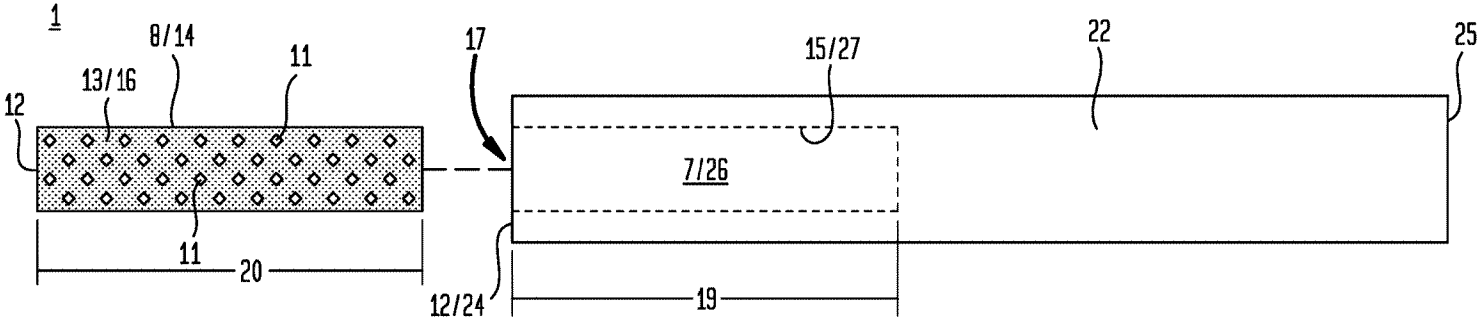
FIG. 3B is an exploded view of the particular embodiment of the inventive sighting device shown in FIG. 3A.
Figure 3C:
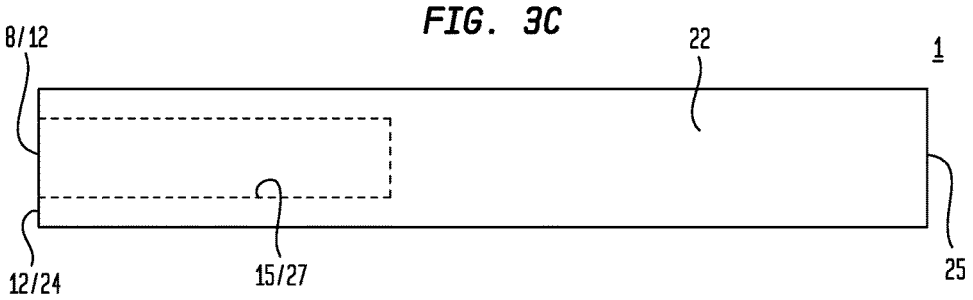
FIG. 3C is a first side view of the particular embodiment of the inventive sighting device shown in FIG. 3A.
Figure 3D:
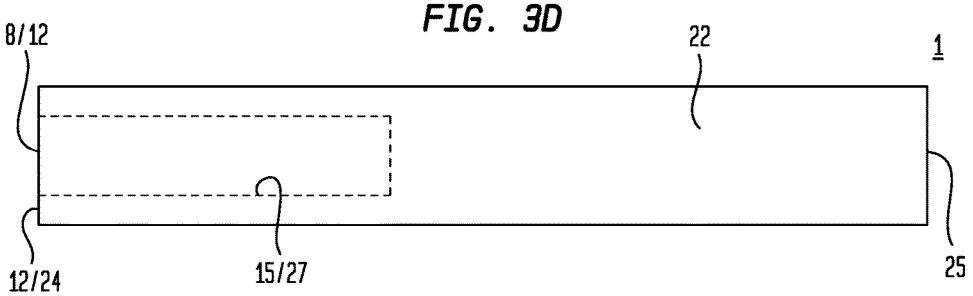
FIG. 3D is a second side view of the particular embodiment of the inventive sighting device shown in FIG. 3A.
Figure 3E:
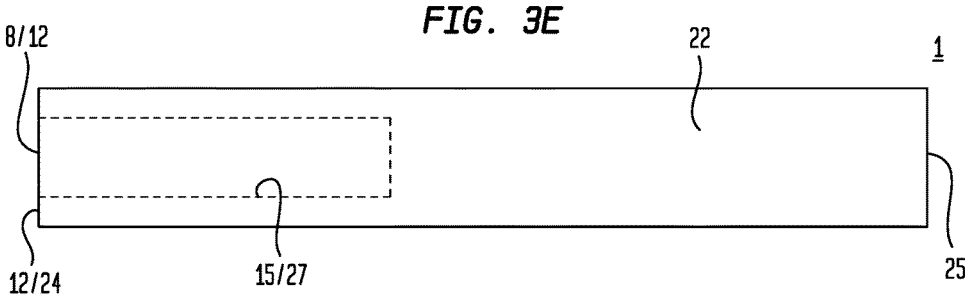
FIG. 3E is a top view of the particular embodiment of the inventive sighting device shown in FIG. 3A.
Figure 3F:
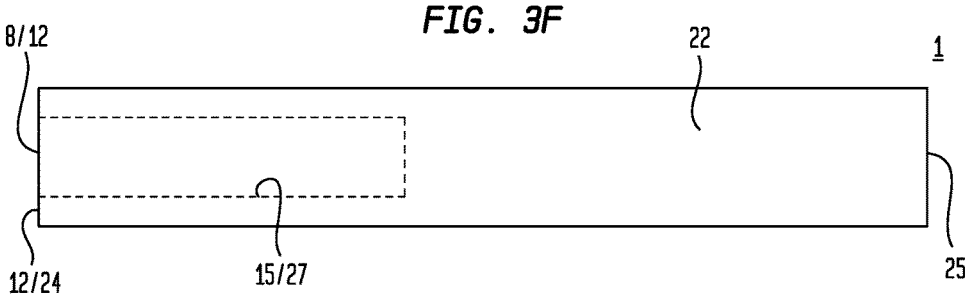
FIG. 3F is a bottom view of the particular embodiment of the inventive sighting device shown in FIG. 3A.
Figure 3G:
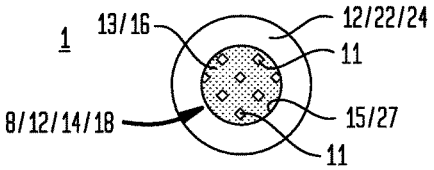
FIG. 3G is a first end view of the particular embodiment of the inventive sighting device shown in FIG. 3A.
Figure 3H:
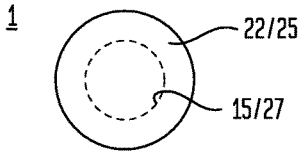
FIG. 3H is a second end view of the particular embodiment of the inventive sighting device shown in FIG. 3A.
Figure 3I:
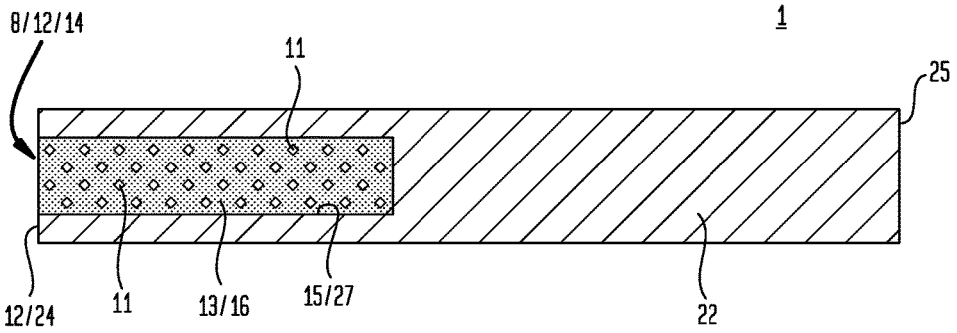
FIG. 3I is a cross-sectional view 3I-3I of the particular embodiment of the inventive sighting device shown in FIG. 3C.
Figure 4I:
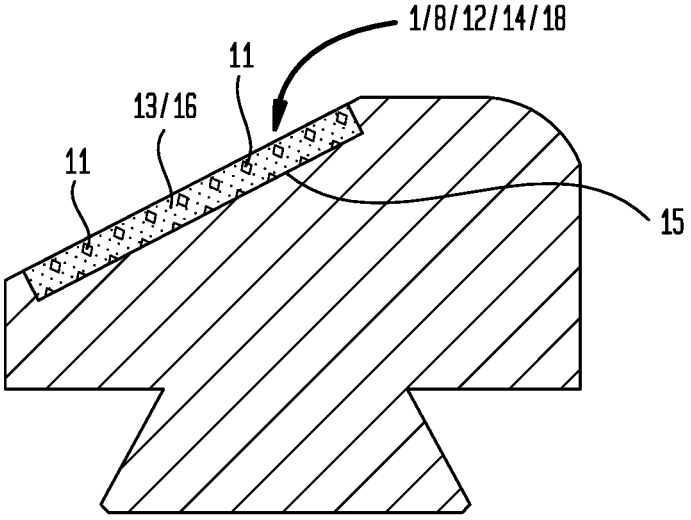
FIG. 4I is a cross-sectional view 4I-4I of the particular embodiment of the inventive sighting device shown in FIG. 4E.

Now referring primarily to FIG. 3B and FIG. 4B, the chamber (7) can have a chamber depth (19) which is not lesser than about 1/32 inch or which is equal to or greater than about 1/32 inch. Accordingly, the cured phosphor-loaded resin (14) contained within the chamber (7) can have a corresponding phosphor-loaded resin depth (20) which is not lesser than about 1/32 inch or which is equal to or greater than about 1/32 inch.

Now referring primarily to FIG. 3B, as but one illustrative example, the chamber (7) can have a chamber depth (19) which is about 9/32 inch. Accordingly, the cured phosphor-loaded resin (14) contained within the chamber (7) can have a corresponding phosphor-loaded resin depth (20) of about 9/32 inch.

Now referring primarily to FIG. 4B, as but another illustrative example, the chamber (7) can have a chamber depth (19) which is about 5/128 inch. Accordingly, the cured phosphor-loaded resin (14) contained within the chamber (7) can have a corresponding phosphor-loaded resin depth (20) of about 5/128 inch.

Of note, in at least this way, the cured phosphor-loaded resin (14) contained within the chamber (7) differs from a coating, such as a coating of phosphorescent paint, which typically has a thickness upon hardening of less than around about 1/64 inch.

The increased amount of phosphorescent material (11) present within the instant phosphor-loaded resin (14) contained within the chamber (7) in relation to the amount of phosphorescent material (11) within a phosphorescent paint coating advantageously permits the instant phosphor-loaded resin (14) to provide greater persistent luminescence, which may be brighter and/or endure for a longer period of time, relative to the phosphorescent paint coating.

As to particular embodiments, the chamber depth (19) and correspondingly, the phosphor-loaded resin depth (20) can be selected from the group including or consisting of: not lesser than about 1/32 inch; not lesser than about 3/64 inch; not lesser than about 1/16 inch; not lesser than about 5/64 inch; not lesser than about 3/32 inch; not lesser than about 7/64 inch; not lesser than about 1/8 inch; not lesser than about 9/64 inch; not lesser than about 5/32 inch; not lesser than about 11/64 inch; not lesser than about 3/16 inch; not lesser than about 13/64 inch; not lesser than about 7/32 inch; not lesser than about 15/64 inch; not lesser than about 1/4 inch; not lesser than about 17/64 inch; not lesser than about 9/32 inch; not lesser than about 19/64 inch; not lesser than about 5/16 inch; not lesser than about 21/64 inch; not lesser than about 11/32 inch; not lesser than about 23/64 inch; not lesser than about 3/8 inch; not lesser than about 25/64 inch; not lesser than about 13/32 inch; not lesser than about 27/64 inch; not lesser than about 7/16 inch; not lesser than about 29/64 inch; not lesser than about 15/32 inch; not lesser than about 31/64 inch; and not lesser than about 1/2 inch.

As to particular embodiments, to achieve a desired persistent luminescence, the chamber depth (19) and correspondingly, the phosphor-loaded resin depth (20) can be associated with or dependent upon the exposed surface area (18) of the phosphor-loaded resin (14) which, as described above, can be defined by the bounds of the chamber open end (17). For example, a greater exposed surface area (18) of the phosphor-loaded resin (14) can require a lesser chamber depth (19) and correspondingly, phosphor-loaded resin depth (20) (as shown in the examples of FIG. 4A through FIG. 4I) in relation to a lesser exposed surface area (18) of the phosphor-loaded resin (14), which can require a greater chamber depth (19) and correspondingly, phosphor-loaded resin depth (20) (as shown in the examples of FIG. 3A through FIG. 3I).

Figure 6A:
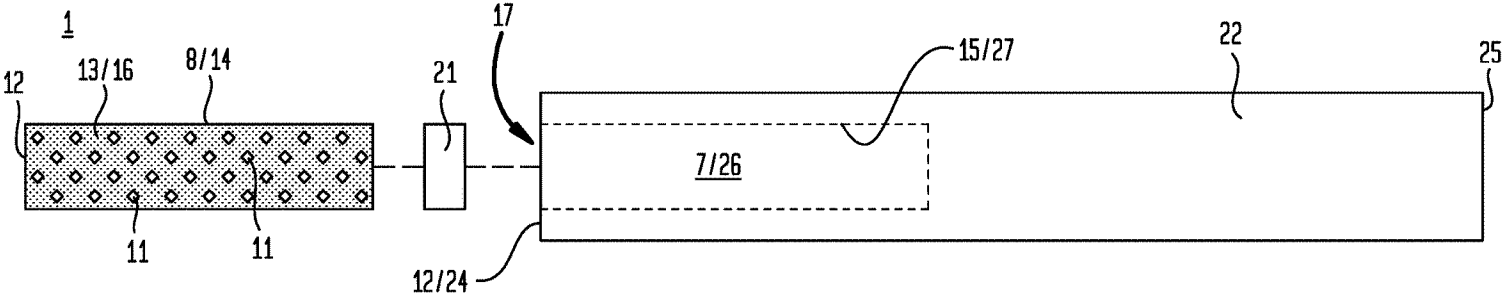
FIG. 6A is an exploded view of a particular embodiment of the inventive sighting device which includes a reflective layer disposed within the chamber to enhance the persistent luminescence of the first amount of visible light emitted by the light-emitting element.
Figure 6B:
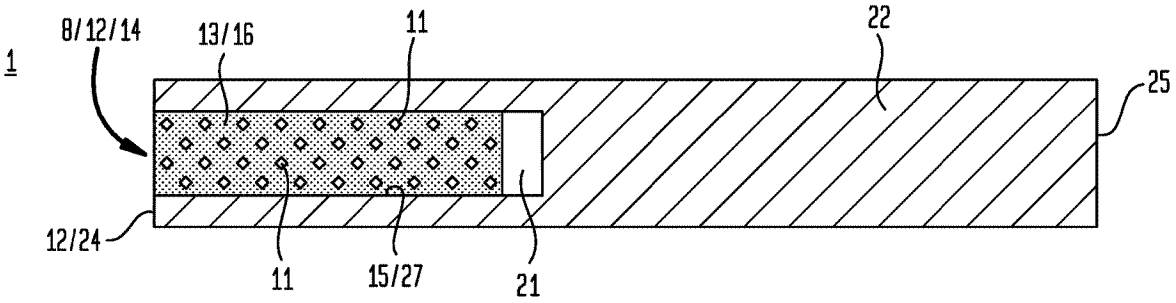
FIG. 6B is a cross-sectional view of a particular embodiment of the inventive sighting device which includes a reflective layer disposed within the chamber to enhance the persistent luminescence of the first amount of visible light emitted by the light-emitting element.

Now referring primarily to FIG. 6A and FIG. 6B, as to particular embodiments, a reflective layer (21) can be disposed within the chamber (7) to enhance the persistent luminescence of the first amount of visible light (9) emitted by the light-emitting element (8) to provide the viewable aiming indicium (12) in low light conditions. As but one illustrative example, the reflective layer (21) can be disposed within the chamber (7) opposite the chamber open end (17) such that the reflective layer (21) can reflect light toward the chamber open end (17) and correspondingly, toward the exposed surface area (18) of the phosphor-loaded resin (14) contained within the chamber (7) which provides the first amount of visible light (9), thereby enhancing the persistent luminescence of the first amount of visible light (9) emitted by the light-emitting element (8).

As but one illustrative example, the reflective layer (21) can be white and can comprise an epoxy resin including titanium dioxide.

Again regarding the chamber (7) which contains the phosphor-loaded resin (14), the chamber (7) contains only non-radioactive material. Accordingly, the phosphorescent material (11) contained within the chamber (7) is non-radioactive. Additionally, the phosphorescent material (11) contained within the chamber (7) is activated or charged by non-radioactive material. As stated above, the phosphorescent material (11) of the instant sighting device (1) emits a first amount of visible light (9) following exposure to a light source (10) which can provide visible light, invisible light (such as ultraviolet light or infrared light), or combinations thereof, to function as an excitation source. Significantly, this is in contrast to conventional low-light illuminators used with weapon sights for night-time target acquisition, which include tritium.

Tritium is a radioactive isotope of the element hydrogen. By mixing tritium with a phosphor that emits light in the presence of radiation in a sealed vial, a continuous light source may be formed. Such a light source may be useful in situations where a dim light is needed but where using batteries or electricity is not possible, such as with weapons sites to increase nighttime firing accuracy.

The use of tritium, however, carries some serious drawbacks. For example, the use of tritium introduces significant safety risks, hazardous waste concerns and measurable legacy costs. Additionally, if the sealed vials containing the radioactive material is damaged, not only is the light source inactivated, but there may be a low level release of radioactivity that must be addressed. Other drawbacks of tritium include the following: 1) depending upon the amount used, tritium is subject to regulation by the Nuclear Regulatory Commission and improper handling and control of tritium can lead to fines and punitive actions; 2) depending upon the amount used, disposal of tritium-containing materials must be handled as radioactive waste, resulting in significant cost and management oversight of such materials; 3) breakage of tritium vials currently must be treated as a Hazardous Material spill; 4) tritium is a radioactive beta particle emitter and thus, if ingested into the digestive tract, inhaled into the lungs or absorbed into the blood stream through an open wound, tritium poses a known health risk; and 5) the half-life of tritium is about 14 years, with decay beginning the day the device incorporating the tritium is made. Thus, tritium light sources typically have an effective life of 5-7 years, at which point they become too dim and must be replaced. In summary, radioactive tritium in weapons sights may present a potential health hazard, logistic difficulties, and significant life cycle handling and disposal costs.

Thus, the instant sighting device (1) provides a much-improved system and method for low-light illumination within weapons sights which is void of radioactive materials including tritium.

Now referring primarily to FIG. 2A through FIG. 3I, as to particular embodiments, the sighting device (1) can, but need not necessarily, further include a light conductive member (22) discrete from the light-emitting element (8), whereby the light conductive member (22) emits a second amount of visible light (23).

Accordingly, the light conductive member (22) can be configured to receive an amount of light from a light source (10) external to the light conductive member (22) and transmit the amount of light internally, in whole or in part, or as modified by any dopants included in light conductive material of the light conductive member (22), for emission as a second amount of visible light (23) from light conductive member opposing first and second ends (24)(25). For example, the light conductive member (22) can fluoresce in response to internal light transmission.

Various light conductive materials can be utilized to produce the light conductive member (22), including, without limitation, extruded, molded, cast, or fabricated plastic (such as polystyrene, polycarbonate, polyvinylchloride, TEFLON, nylon, polystyrene, polyurethane, acrylic, polyethylene terphthalate, polyethersulfone, polymethylmethacrylate, or the like, separately or in various combinations thereof). Particular embodiments of the light conductive member (22), as a consequence of the type of light conductive material or the constructional form of the light conductive member (22) (or as a consequence of both), can achieve total internal reflection, substantial internal reflection, or the desired level of internal reflection of the amount of light incident on the light conductive member (22) to allow transmission of all, substantially all, or a desired amount of light to at least one of the light conductive member first and second ends (24)(25).

A further description of the light conductive member (22) is provided in U.S. Pat. No. 8,925,237 titled "Photoluminescent (PL) Weapon Sight Illuminator", which is hereby incorporated by reference herein in its entirety.

Again referring primarily to FIG. 2A through FIG. 3I, the chamber (7) can be disposed inside of the light conductive member (22), correspondingly disposing the light-emitting element (8) contained within the chamber (7) inside of the light conductive member (22).

Now referring primarily to FIG. 3A through FIG. 3I, as but one illustrative example, the chamber (7) can be provided by a bore (26), such as a cylindrical bore (26), longitudinally disposed within the light conductive member (22). As to particular embodiments, the bore (26) can longitudinally extend a distance within the light conductive member (22) from the light conductive member first end (24), thereby aligning the chamber open end (17) with the light conductive member first end (24) and positioning the exposed surface area (18) of the phosphor-loaded resin (14) contained within the chamber (7) proximate the light conductive member first end (24).

Again referring primarily to FIG. 3A through FIG. 3I, as to particular embodiments, a light conductive member internal surface (27) of the light conductive member (22) can provide the chamber walls (15) which define the chamber (7) disposed inside of the light conductive member (22).

Again referring primarily to FIG. 3A through FIG. 3I, as to particular embodiments, the chamber (7) and correspondingly, the light-emitting element (8) can dispose in coaxial relation to the light conductive member (22).

Again referring primarily to FIG. 3A through FIG. 3I, as to particular embodiments, the chamber (7) and correspondingly, the light-emitting element (8) can be concentrically disposed within the light conductive member (22).

Again referring primarily to FIG. 3A through FIG. 3I, as to particular embodiments, the light conductive member (22), the chamber (7) and correspondingly, the light-emitting element (8) can be configured as cylinders or cylindrically-shaped.

As to particular embodiments, the light-emitting element (8) contained within the chamber (7) can be partially disposed inside of the light conductive member (22). For example, the entire light-emitting element (8) except for the exposed surface area (18) can be disposed inside of the light conductive member (22) such that the light conductive member (22) surrounds the entire light-emitting element (8) except for the exposed surface area (18) (as shown in the examples of FIG. 3A through FIG. 3I).

As to other particular embodiments, the light-emitting element (8) contained within the chamber (7) can be wholly disposed inside of the light conductive member (22) such that the light conductive member (22) entirely surrounds the entire light-emitting element (8) (not shown).

As to particular embodiments, the sighting device (1) can, but need not necessarily, further include a cover, whether translucent or transparent, which can cover the chamber open end (17) to overlay the cured phosphored-loaded resin (14) contained within the chamber (7).

As to particular embodiments, the cover can cover both the chamber open end (17) and the light conductive member first end (24).

As to particular embodiments, the sighting device (1) can, but need not necessarily, further include a lens coupled, directly coupled, or connected to the light conductive member (22) proximate the chamber open end (17), whereby the lens has a configuration which spreads the first and second amounts of visible light (9)(23) over an illumination field to provide the viewable aiming indicium (12).

A further description of the lens is provided in U.S. Pat. No. 8,925,237 titled "Photoluminescent (PL) Weapon Sight Illuminator", which is hereby incorporated by reference herein in its entirety.

As to particular embodiments, the sighting device (1) can, but need not necessarily, further include a base configured to receive the light-emitting element (8) contained within the chamber (7) disposed inside of the light conductive member (22), whereby the base can be coupled to the weapon (2) in fixed (or immovable) or adjustable relation to allow positional alignment of the sighting device (1) to assist with or facilitate aiming the weapon (2) at a target (3) to direct a projectile (4) toward the target (3).

A further description of the base is provided in U.S. Pat. No. 8,925,237 titled "Photoluminescent (PL) Weapon Sight Illuminator", which is hereby incorporated by reference herein in its entirety.

Now regarding production, a method of making the instant sighting device (1) includes coupling a chamber (7) to the sighting device (1) and disposing a light-emitting element (8) within the chamber (7), wherein the chamber (7) contains only non-radioactive material, and wherein the light-emitting element (8) emits a first amount of visible light (9) to provide a viewable aiming indicium (12) in low light conditions.

The method of making the instant sighting device (1) can further include providing additional components of the sighting device (1) as described above and in the claims.

As but one illustrative example, particular embodiments of the instant sighting device (1) which include a chamber (7) and correspondingly, a light-emitting element (8) disposed inside of a light conductive member (22), can be made by boring a bore (26) within the light conductive member (22) proximate the light conductive member first end (24) such that the chamber open end (17) aligns with the light conductive member first end (24). Following, the phosphor-loaded resin (14), which can be provided as a fluid, can be disposed within the chamber (7) by flowing the phosphor-loaded resin (14) through the chamber open end (17). Upon containment within the chamber (7), the phosphor-loaded resin (14) can be cured by conventional curing methods to fix the phosphor-loaded resin (14) within the chamber (7) and correspondingly, inside of the light conductive member (22), allowing the exposed surface area (18) of the phosphor-loaded resin (14) to provide the first amount of visible light (9) and the viewable aiming indicium (12).

Now regarding use, a method of using the inventive sighting device (1) includes obtaining the above-described sighting device (1) and coupling the sighting device (1) to a weapon (2).

As to particular embodiments, the method of use can further include exposing the phosphorescent material (11) to a light source (10) to activate or charge the phosphorescent material (11), permitting the phosphorescent material (11) to emit a first amount of visible light (9) after discontinuation of exposure to the light source (10) to provide persistent luminescence.

As to particular embodiments, the method of use can further include viewing the persistent luminescence of the first amount of visible light (9) emitted by the phosphorescent material (11) to assist with or facilitate aiming the weapon (2) at a target (3) to direct a projectile (4) toward the target (3).

As can be easily understood from the foregoing, the basic concepts of the present invention may be embodied in a variety of ways. The invention involves numerous and varied embodiments of a weapon sight light emission system which can be incorporated into a wide variety of sights for weapons.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a sight" should be understood to encompass disclosure of the act of "sighting"—whether explicitly discussed or not—and, conversely, were there effectively disclosure of the act of "sighting", such a disclosure should be understood to encompass disclosure of "sighting" and even a "means for sighting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a light source" refers to one or more of those light sources. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus, the applicant(s) should be understood to claim at least: i) each of the weapon sight light emission systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A sighting device configured for use with a weapon, comprising:

a chamber coupled to said sighting device; and a light-emitting element contained within said chamber;

wherein said light-emitting element comprises a phosphorescent material loaded within a curable resin to provide a phosphor-loaded resin;

wherein said phosphorescent material emits a first amount of visible light following exposure to a light source to provide a viewable aiming indicium in low light conditions;

wherein said phosphorescent material continues to emit said first amount of visible light after discontinuation of exposure to said light source to provide persistent luminescence;

wherein said phosphorescent material comprises strontium aluminate doped with europium and dysprosium; and wherein said chamber contains only non-radioactive material.

2. The sighting device of claim 1, wherein said resin adheres to one or more walls defining said chamber to fixedly secure said phosphor-loaded resin within said chamber.

3. The sighting device of claim 2, wherein said resin comprises an epoxy resin.

4. The sighting device of claim 2, wherein said strontium aluminate doped with europium and dysprosium loaded within said resin comprises $SrAl_2O_4$:Eu,Dy.

5. The sighting device of claim 4, wherein said epoxy resin comprises poly(bisphenolA-co-epichlorohydrin).

6. The sighting device of claim 5, wherein an amount of said $SrAl_2O_4$:Eu,Dy is in a range of between about 50% to about 80% by weight of said phosphor-loaded resin.

7. The sighting device of claim 6, wherein an amount of said poly(bisphenolA-co-epichlorohydrin) is not greater than about 35% by weight of said phosphor-loaded resin.

8. The sighting device of claim 1, wherein said chamber has a chamber depth which is not lesser than about 1/32 inch.

9. The sighting device of claim 8, wherein said phosphor-loaded resin contained within said chamber has a corresponding phosphor-loaded resin depth which is not lesser than about 1/32 inch.

10. The sighting device of claim 1, further comprising a reflective layer disposed within said chamber to enhance said persistent luminescence of said first amount of visible light.

11. The sighting device of claim 1, further comprising a light conductive member, wherein said chamber is disposed inside of said light conductive member.

12. The sighting device of claim 11, wherein said chamber is provided by a bore longitudinally disposed within said light conductive member.

13. The sighting device of claim 12, wherein said chamber disposes in coaxial relation to said light conductive member.

14. The sighting device of claim 13, wherein said chamber is concentrically disposed within said light conductive member.

15. The sighting device of claim 14, wherein said light conductive member, said chamber, and said light-emitting element are cylindrically-shaped.

* * * * *